US005191689A

United States Patent [19]

Slesinski et al.

[11] Patent Number: 5,191,689

[45] Date of Patent: Mar. 9, 1993

[54] GROMMET INSTALLATION DEVICE

[75] Inventors: Raymond J. Slesinski, Arnold; Christian E. Schaefer, Glendale, both of Mo.

[73] Assignee: McDonnell Douglas Corporation, St. Louis, Mo.

[21] Appl. No.: 877,406

[22] Filed: May 1, 1992

[51] Int. Cl.[5] ..... B23P 11/00

[52] U.S. Cl. ..... 29/243.517

[58] Field of Search ..... 29/243.517, 243.519, 29/243.521, 243.523, 243.524, 243.53, 243.54; 72/391.4, 453.19

[56] References Cited

U.S. PATENT DOCUMENTS 1,225,265 5/1917 Miller .
1,908,824 12/1930 Devendor et al. .
2,122,557 7/1938 Canter ..... 29/243.519
2,533,870 12/1948 Bayer .
2,746,633 5/1956 Simmons ..... 29/243.517
3,442,112 5/1969 Abromavage et al. ..... 29/243.517

*Primary Examiner*—Robert C. Watson
*Attorney, Agent, or Firm*—Timothy H. Courson; Benjamin Hudson, Jr.

[57] ABSTRACT

A grommet installation device consisting of an installation tool and a backup tool. The backup tool incorporates a retractable rod for guiding and aligning the grommet sleeve throughout installation. The installation tool flares and swages the grommet sleeve over a grommet spacer, affixing the grommet assembly in the workpiece aperture.

8 Claims, 1 Drawing Sheet

FIG. 1.
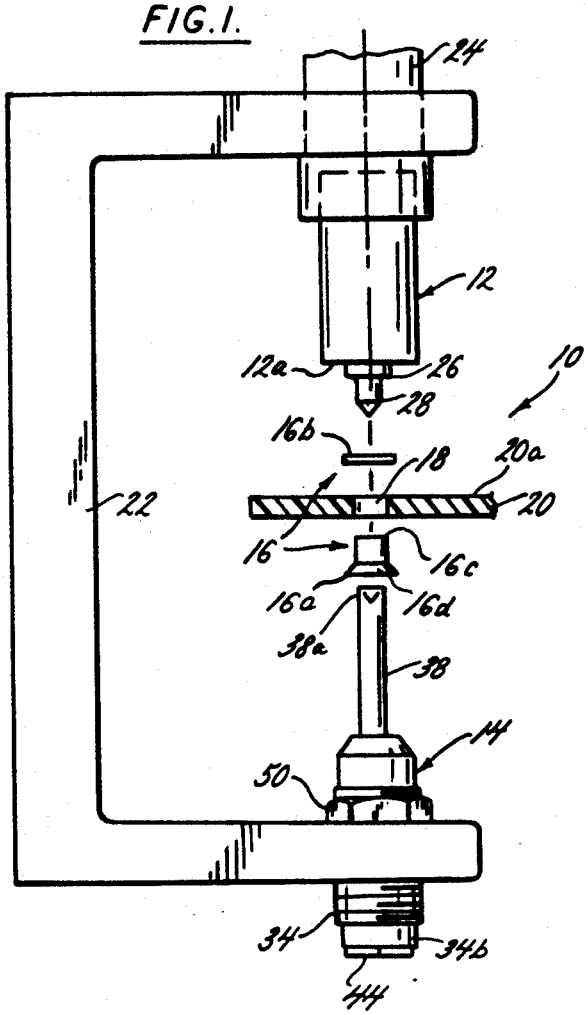
FIG. 2.
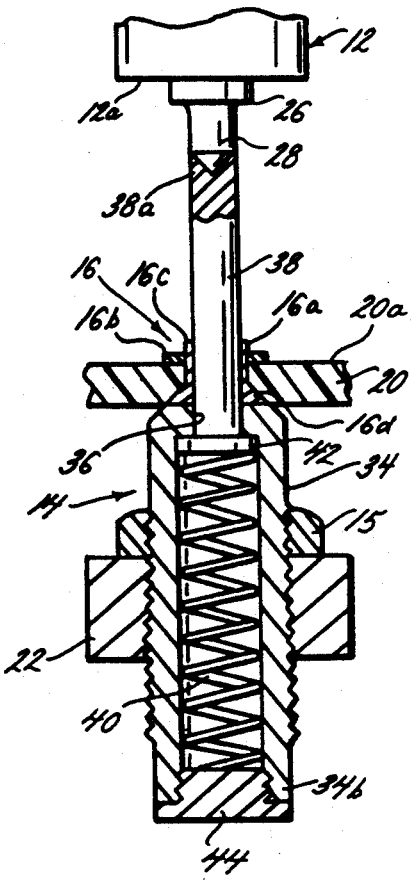
FIG. 3.
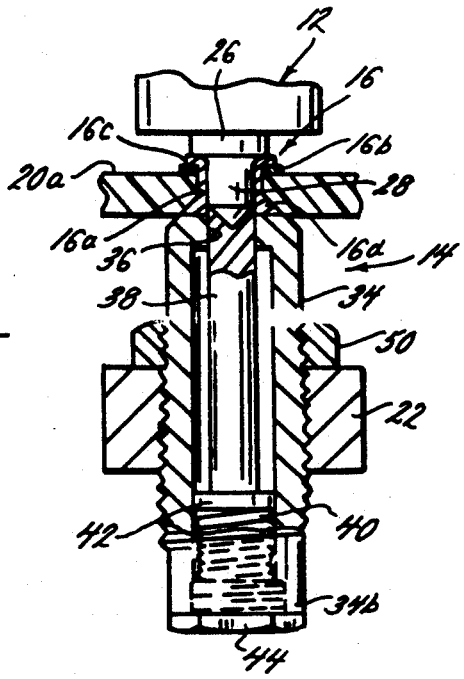
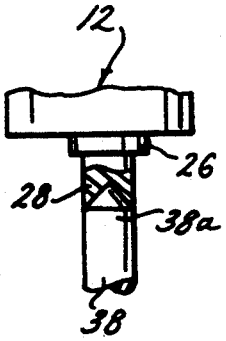
FIG. 4.

GROMMET INSTALLATION DEVICE

BACKGROUND OF THE INVENTION

The present invention relates to a grommet installation device which aligns, supports, and stabilizes a grommet sleeve within a workpiece aperture prior to flaring and swaging an end of the grommet sleeve over the periphery of a grommet spacer.

It is common practice in manufacturing to join composite materials together with fasteners installed through apertures lined with grommets. The installation of a grommet generally requires the use of two tools: a backup tool to support one end of the grommet sleeve and an installation tool to flare and swage the other end of the grommet sleeve over the periphery of the grommet spacer.

Conventional backup and installation tools do not effectively provide stability and guidance to the grommet assembly throughout installation. There is therefore a need in the art for a grommet installation device which provides a secure interface between the installation tool and the backup tool and which aids in aligning and stabilizing the grommet during installation.

SUMMARY OF THE INVENTION

The present invention provides an improved device for installing a grommet into a workpiece aperture. Typical grommets utilized in this invention consist of a grommet sleeve and a grommet spacer: the grommet sleeve extends through both the aperture of the workpiece and the grommet spacer.

The grommet installation device of the present invention is comprised of both an installation tool and a backup tool. The backup tool includes a housing, threaded about its circumference, having a tapered end defining an aperture. The aperture provides an opening through which a headed, retractable rod extends. The retractable rod travels axially within the housing and assures guidance and alignment for the grommet sleeve throughout installation. The retractable rod also prevents grommet binding which can result in damage to the workpiece. The rod is engaged and elevated to its effective position by a spring contained within the housing. The rod is retained within the housing by means of the headed end of the rod which has a diameter larger than that of the aperture. In the preferred embodiment, the backup tool is threadably embedded within a holding body.

The grommet sleeve is maintained and supported within the aperture of the workpiece by the backup tool while the circumferential lip of the grommet sleeve is flared and swaged over the periphery of the grommet spacer by the installation tool. The installation tool has a modified end for mating with the distal end of the backup tool and a flaring jacket and a swaging jacket for flaring and swaging, respectively, the circumferential lip of the grommet sleeve over the periphery of the grommet spacer and affixing the grommet assembly to the aperture of the workpiece.

The design of the present invention therefore provides support and stabilization to the grommet throughout installation. It also provides stability to both the grommet and the workpiece. As a result, the grommet installation device remedies misalignment and stability problems.

BRIEF DESCRIPTION OF THE DRAWINGS

FIG. 1 is a perspective view of the grommet installation device of the present invention, in its initial unengaged position, imbedded within a working table;

FIG. 2 is an enlarged perspective view of the installation device, during engagement, for more fully illustrating its novelty; and FIG. 3 is a perspective view of the installation device while flaring and swaging the grommet sleeve over the grommet spacer.

FIG. 4 is an alternative embodiment of the present invention showing the male and female ends of the grommet installation device reversed.

DETAILED DESCRIPTION OF THE PREFERRED EMBODIMENT

In FIGS. 1-3, there is shown a preferred embodiment of a grommet installation device 10 incorporating the principles of the present invention. Referring to FIG. 1, grommet installation device 10 includes an installation tool 12, such as Tridair installation tool model numbers CA21082-4-T12 or CA35832-4-FT16, used in conjunction with a backup tool 14. Grommet installation tool 10 is employed to affix a grommet, such as grommet 16, into an aperture 18 of workpiece 20. Grommet 16 includes a grommet sleeve **16*a* and a grommet spacer 16*b*; grommet spacer 16*b* is positioned on the upper surface of workpiece 20. Grommet sleeve 16*a* has a pliable upper end 16*c* and a flared lower end 16*d***.

Installation tool 12 is fixedly attached to hydraulic actuated cylinder 24 which is attached to holding body 22 shown as a "C" shape in FIG. 1 for exemplary purposes. As shown in FIG. 2, installation tool 12 further consists of a swaging jacket 26 attached at end **12*a*. An upper portion of a flaring jacket 28 is attached to swaging jacket 26 while the lower portion of flaring jacket 28 is cone-shaped and provides the male end for a secure connection to backup tool 14; this arrangement at the interface of the lower portion of flaring jacket 28 and backup tool 14 provides guidance and stability for grommet 16 throughout installation. Swaging jacket 26 has a diameter slightly larger than that of grommet sleeve 16*a*. Flaring jacket 28, at the upper portion of flaring jacket 28, tapers from a diameter larger than the diameter of grommet sleeve 16*a* to a diameter smaller than that of grommet sleeve 16*a*, at the lower portion of the flaring jacket 28. The respective differences in diameters provide a means of both flaring and swaging grommet sleeve 16*a* over grommet spacer 16*b* around the perimeter of aperture 18. While swaging jacket 26 and flaring jacket 28** were previously discussed as two distinct items, they may be formed as an integral element.

Backup tool 14 consists of a cylindrical housing 34 threaded about its external circumference. Backup tool 14 is also internally threaded at its lower end. The threading about the circumference of housing 34 provides a means for adjustably threading housing 34 into a bottom section of housing body 22 so that backup tool 14 can be securely attached to the bottom section of holding body 22. The tapered, top portion of housing 34 defines an aperture 36 through which a distal end **38*a* of headed, cylindrical rod 38 retractably extends. Cylindrical rod 38 travels axially within a longitudinal chamber within housing 34 and is retained within the housing's chamber by headed end 42 of rod 38 which has a diameter larger than that of both the aperture 36 and the remainder of cylindrical rod 38. A helical spring 40, contained within the longitudinal chamber of housing 34, urges cylindrical rod 38 to its fully extended position through aperture 36 barring external forces on rod 38. The ability of cylindrical rod 38 and helical spring 40 to retractably extend through aperture 36 provides guidance to grommet sleeve 16***a* throughout installation. Distal end 38*a* of cylindrical rod 38 is cup-shaped and thereby provides the complementary female end for a secure connection with the tapered male end of flaring jacket 28. In an alternative embodiment, distal end 38*a* of cylindrical rod 38 can incorporate the male end and flaring jacket 28 can provide the female end for a secure connection at the interface between installation tool 12 and backup tool 14.

The headed end 42 of cylindrical rod 38, in addition to retaining cylindrical rod 38 within housing 34, provides a seat for cylindrical rod 38 to sit on spring 40 concentrically. Helical spring 40 extends longitudinally within housing 34 and is maintained within housing 34 at one end by headed end 42 of the cylindrical rod 38 and at the other end by a plug 44 threaded into the lower portion of housing 34. In an alternative embodiment, housing 34 can be completely enclosed at end 34*b* to maintain helical spring 40 within housing 34.

Prior to operation, as shown in FIG. 1, installation tool 12 is positioned above aperture 18, defined within workpiece 20, and cylindrical rod 38 of backup tool 14 is initially in an extended position below aperture 18. Operation of the preferred embodiment is carried out in the following manner: housing 34 is threadably embedded within the bottom section of holding body 22 and adjusted upwardly or downwardly to provide adequate clearance between workpiece 20 and installation tool 12. Backup tool 14 is then secured in position using a locking nut 50. Note that the threading about the circumference of housing 34 allows grommet installation device 10 to be adapted to changes in thickness or contour of workpiece 20 by adjusting backup tool 14 translationally.

In the installation process, grommet sleeve 16*a* and grommet spacer 16*b* are securely joined at surface 20*a* of workpiece 20 around the perimeter of aperture 18. As shown in FIG. 2, grommet sleeve 16*a* is slidably disposed on cylindrical rod 38 and initially rests concentrically on the tapered, top portion of housing 34. Note that the taper of housing 34 is complementary to the taper of end 16*d* of grommet sleeve 16*a*. When used together, cylindrical rod 38 and flaring jacket 28 provide alignment and guidance for grommet sleeve 16*a* throughout installation.

Following translational adjustment and securing of backup tool 14, workpiece 20 and grommet spacer 16*b* are positioned about cylindrical rod 38 such that cylindrical rod 38 protrudes through aperture 18 in workpiece 20 and through grommet spacer 16*b*, as shown in FIG. 2. End 16*c* of grommet sleeve 16*a* extends through grommet spacer 16*b* to provide a circumferential lip.

As shown in FIG. 3, cylinder 24 is actuated to drive flaring jacket 28 downward until a secure connection is made with cylindrical rod 38. Cylinder 24 continues to be actuated to force flaring jacket 28 and cylindrical rod 38 downward through aperture 18. The downward translational movement of flaring jacket 28 and cylindrical rod 38 causes helical spring 40 to compress within housing 34. Grommet sleeve 16*a* remains stationary, as flaring jacket 28 and cylindrical rod 38 travel through its diameter, resting on housing 34 during the entire process. Cylinder 24 continues to push downward, and, as a result, flaring jacket 28 flares the circumferential lip of grommet sleeve 16*a* and swaging jacket 26 swages the flared circumferential lip of grommet sleeve 16*a* over the periphery of grommet spacer 16*b*. When the grommet assembly is securely affixed to workpiece 20, cylinder 24 is retracted, returning to its initial position above aperture 18.

Changes and modifications in the specifically described embodiments can be carried out by those skilled in the art without departing from the spirit of the invention which is intended to be limited only by the scope of the appended claims.

What is claimed is:

1. A device for installing a grommet into a workpiece defining an aperture, comprising:

(a) means for swaging said grommet into said aperture:

(b) means for supporting said grommet within said aperture of said workpiece, wherein said supporting means comprises:

(1) a cylindrical housing:

(2) retractable means, having a headed end retained within said cylindrical housing, for maintaining said grommet in said workpiece during installation; and (3) means, enclosed within said cylindrical housing, for retractably extending said retractable maintaining means; and (c) means for aligning said swaging means with said supporting means during installation.

2. A device for installing a grommet into a workpiece defining an aperture, comprising:

(a) means for swaging said grommet into said aperture;

(b) means for supporting said grommet within said aperture of said workpiece, wherein said supporting means comprises:

(1) a cylindrical housing:

(2) retractable means, having a headed end retained within said cylindrical housing, for maintaining said grommet in said workpiece during installation; and (3) means, enclosed within said cylindrical housing, for retractably extending said retractable maintaining means; and (c) means for aligning said swaging means with said supporting means during installation, wherein said aligning means comprises:

(1) a male connection at a distal end of said swaging means; and (2) a female connection at a distal end of said maintaining means for receiving said male connection.

3. The device for installing a grommet into a workpiece as recited in claim 1, wherein said aligning means comprises:

(a) a male connection at the distal end of said maintaining means; and (b) a female connection at the distal end of said swaging means for receiving said male connection.

4. A device for installing a grommet into a workpiece defining an aperture, comprising:

(a) means for swaging said grommet into said aperture;

(b) means for supporting said grommet within said aperture of said workpiece, wherein said supporting means comprises:

(1) a cylindrical housing;

(2) retractable cylindrical rod, having a headed end retained within said cylindrical housing, for maintaining said grommet in said workpiece during installation, and (3) means, enclosed within said cylindrical housing, for retractably extending said retractable maintaining means; and (c) means for aligning said swaging means with said supporting means during installation, wherein said aligning means comprises:

(1) a male connection at a distal end of said swaging means; and (2) a female connection at a distal end of said maintaining means for receiving said male connection.

5. The device for installing a grommet into a workpiece as recited in claim 3, wherein said retractable maintaining means is a cylindrical rod.

6. A device for installing a grommet into a workpiece defining an aperture, comprising:

(a) means for swaging said grommet into said aperture; and (b) means for supporting said grommet within said aperture of said workpiece, wherein said supporting means comprises:

(1) a cylindrical housing;

(2) retractable means, having a headed end retained within said cylindrical housing, for maintaining said grommet in said workpiece during installation; and (3) means, enclosed within said cylindrical housing, for retractably extending said retractable maintaining means, wherein said cylindrical housing has an external, threaded circumference and a tapered end, said tapered end defining an aperture having a diameter of the headed end of said retractable maintaining means for retaining said maintaining means within said housing.

7. The device for installing a grommet into a workpiece as recited in claim 1, wherein said extending means is a helical spring.

8. A device for installing a grommet into a workpiece defining an aperture, comprising:

(a) means, for swaging said grommet into said aperture of said workpiece, having a male connection at a distal end;

(b) a cylindrical housing for supporting said grommet within said workpiece aperture, wherein a tapered first end of said cylindrical housing defines an aperture, therein, and wherein said cylindrical housing has an external, threaded circumference;

(c) a retractable cylindrical rod, wherein a distal first end of said retractable cylindrical rod has a female connection for receiving said male connection of said swaging means, and wherein a second headed end of said retractable cylindrical rod is retained within said cylindrical housing; and (d) a helical spring enclosed within said cylindrical housing.

* * * * *